US006039018A

United States Patent [19]

Spath

[11] Patent Number: 6,039,018

[45] **Date of Patent: *Mar. 21, 2000**

[54] HYDRAULIC LASH ADJUSTER WITH PLUNGER INNER CONTROL RING

[75] Inventor: Mark James Spath, Spencerport, N.Y.

[73] Assignee: General Motors Corporation, Detroit, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/252,144

[22] Filed: Feb. 18, 1999

[51] Int. Cl.[7] ..... F01L 1/24

[52] U.S. Cl. ..... 123/90.55; 123/90.19; 123/90.43; 123/90.57

[58] Field of Search ..... 123/90.19, 90.35, 123/90.36, 90.39, 90.41, 90.43, 90.46, 90.48, 90.49, 90.55, 90.57

[56] References Cited

U.S. PATENT DOCUMENTS

| | | | |
|---|---|---|---|
| 3,598,095 | 8/1971 | Ayres | 123/90.35 |
| 5,307,769 | 5/1994 | Meagher et al. | 123/90.5 |
| 5,408,959 | 4/1995 | Speil | 123/90.55 |

FOREIGN PATENT DOCUMENTS

| | | | |
|---|---|---|---|
| 281990 | 9/1988 | European Pat. Off. | 123/90.43 |
| 3724655 | 8/1988 | Germany | 123/90.57 |
| 197 13 303A1 | 1/1998 | Germany . | |

*Primary Examiner*—Weilun Lo
*Attorney, Agent, or Firm*—Vincent A. Cichosz

[57] ABSTRACT

A hydraulic lash adjuster having, in preferred embodiments, a body carrying a reciprocable plunger defining with a closed end of the body, a high pressure oil chamber from which oil may escape through a primary clearance between the plunger and body. Make up oil is fed from a low pressure chamber defined within the plunger. Thermal pump up of the lash adjuster is prevented by a control ring within the plunger which varies the leakdown path with oil temperature so that normal flow is attained at normal engine operating temperature and the clearance is increased to maintain adequate flow at cold engine starting and operating temperatures. In a first embodiment, the control ring forces the side wall of the plunger outward to reduce the primary clearance between the plunger and body. In a second embodiment, the control ring is loose in the plunger and controls a secondary clearance between the control ring and side wall of the plunger which allows higher flow at low temperatures and is reduced or eliminated at normal operating temperatures so that the primary clearance is controlling.

7 Claims, 3 Drawing Sheets

HYDRAULIC LASH ADJUSTER WITH PLUNGER INNER CONTROL RING

TECHNICAL FIELD

This invention relates to hydraulic lash adjusters for taking up lash in the valve trains of engines and, more particularly, to lash adjusters that include means to vary the leakdown clearance and to prevent thermal pump up of the lash adjusters from holding open the valves during cold engine operation after start up.

BACKGROUND OF THE INVENTION

A hydraulic lash adjuster capable of taking up lash in an engine valve train, commonly includes two major elements, a body and a plunger. Such a lash adjuster may form a pivot for a camshaft finger follower, may be driven by a cam to actuate a valve actuating member such as a push rod or rocker arm, or may act as a hydraulic element assembly in a direct acting hydraulic valve lifter. In general, the body is a cup-shaped or cylindrical member having a peripheral outer wall with closed and open ends. The plunger may have the general form of a hollow piston with a rounded end for acting as a pivot for an associated finger follower or an end formed with a socket for engaging a push rod. Alternatively, the plunger may have an open end engagable with a cooperating member of an engine valve train. Such cooperating members include a separate piston having a rounded pivot or recessed socket end, and an end wall of a direct acting cam follower shell.

The plunger is reciprocably received within the body with close clearance for controlling the leakdown of oil between the adjoining surfaces. An inner end of the plunger includes means defining a wall with a check valve controlled orifice leading from an oil reservoir within the plunger to an enclosed space between the lower plunger wall and the closed end of the body which forms a high pressure chamber. The oil reservoir is supplied from the engine through passages in or adjacent the body and plunger.

In operation, when the associated engine valve is closed and the cam follower engages the cam on its base circle, a plunger spring, in the high pressure chamber, forces the plunger outward to take up lash between the plunger and its cooperating member, and thus remove all lash from the valve train. This lowers the pressure in the high pressure chamber so that oil is drawn from the reservoir in the plunger through the check valved orifice into the high pressure chamber which is maintained full of oil. During the next valve opening cycle, the reaction force from the engine valve spring acts downwardly against the plunger, increasing pressure in the high pressure chamber and forcing some of the oil therein through clearances between the plunger and body and out of the high pressure chamber. During operation at normal engine temperatures, this oil is replaced by makeup oil from the plunger reservoir when the valve is closed on the next phase of its operating cycle.

During start up of a cold engine, oil viscosity is high and exhaust valve growth is rapid so that a hydraulic lash adjuster which uses a spring biased plunger may not provide a sufficient leakdown rate to provide a rate of shortening of the lash adjuster adequate to avoid holding the valve off its seat on the cam base circle, a condition sometimes called thermal pump up. This condition may cause improper engine operation or stalling and thus requires correction.

Mechanically lashed valve trains provide sufficient lash to accommodate transient growth of valve train components following start up. However, they do not have the capability of automatically compensating for build tolerances and wear over the life of the engine as hydraulic lifters do. Means for correcting the thermal pump up problem while retaining the benefits of hydraulic lash adjusters are accordingly desired.

SUMMARY OF THE INVENTION

The present invention provides a solution of the cold start thermal pump up problem by providing a control ring having a thermal expansion rate greater than that of a cylindrical side wall of the plunger and cooperating with the cylindrical side wall to control leakdown of hydraulic fluid through a leakdown path from the high pressure chamber during valve opening events of the valve train.

In one embodiment, the leakdown path is formed by a primary clearance between the plunger and an internal cylinder of the body. The control ring is tightly fitted against the interior of the plunger cylindrical side wall. The primary clearance is made large enough so that, when the engine is cold, leakdown of fluid from the high pressure chamber will be sufficient to prevent thermal pump up of the lash adjuster so the associated valve will not be held off its seat under any operating condition. As the engine warms up to normal operating temperature, the control ring expands, applying an increasing force against the plunger cylindrical wall and forcing it to expand faster than the body in which it operates. This reduces the primary clearance between the body and plunger until a desired leakdown rate is reached under normal operating conditions.

In an alternative embodiment, the control ring is loosely fitted within the plunger cylindrical wall so that a secondary clearance between them provides a secondary leakdown path for fluid flow out of the high pressure chamber. The secondary leakdown path may communicate with the high pressure chamber through an opening in the plunger cylindrical wall connecting with the primary clearance. A flat machined on the exterior of the plunger may form a passage to connect the plunger opening with the high pressure chamber. When the engine is cold, the loosely fitted control ring allows sufficient fluid leakdown flow through the secondary clearance to prevent thermal pump up of the lash adjuster under all conditions. As the engine warms to normal operating temperature, the secondary clearance is reduced, and may be completely closed, so that most or all the leakdown flow passes through the primary clearance between the plunger and body.

These and other features and advantages of the invention will be more fully understood from the following description of certain specific embodiments of the invention taken together with the accompanying drawings.

DESCRIPTION OF THE PREFERRED EMBODIMENT

Figure 1:
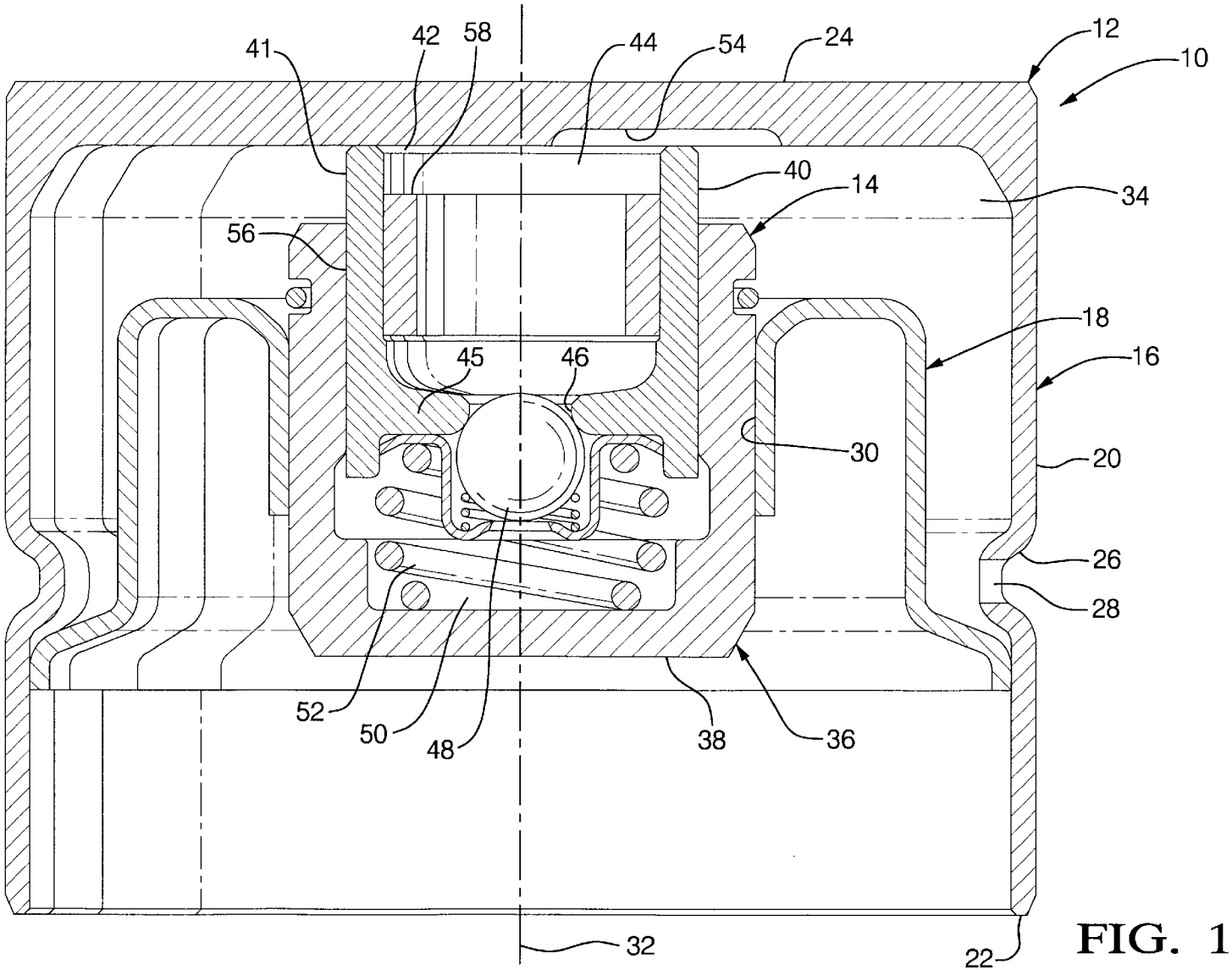
FIG. 1 is a transverse cross-sectional view of a direct acting hydraulic valve lifter including a hydraulic lash adjuster according to the invention.

Referring now to FIG. 1 of the drawings in detail, numeral 10 generally indicates a direct acting hydraulic valve lifter (DAHVL) of a type directly engagable with a cam and a valve for actuating the valve in an engine valve train. Lifter 10 comprises a cam follower 12 and a hydraulic element assembly (HEA) 14. The follower 12 includes a cup like outer shell 16 and an inner baffle 18.

The shell 16 has an annular skirt or outer wall 20 with an open bottom end 22 and a cam engaging head forming a closed upper end 24. Between its ends, the wall 20 has an annular groove 26 having one or more oil inlet openings 28 passing through the shell.

The baffle 18 is retained in a central portion of the shell and includes a portion defining an inner cylinder 30 centered on an axis 32 of the shell. The baffle 18 extends outward from the inner cylinder 30 to engagement with the outer wall 20 below the groove 26 to define an enclosed an annular first space 34 between the baffle 18 and the closed upper end 24

The hydraulic element assembly 14 constitutes a hydraulic lash adjuster that includes a hollow body 36 reciprocably guided in the inner cylinder 30 and having a closed end 38 facing away from the closed end 24 of the shell. Internally, the body 36 carries a reciprocable plunger 40 with a cylindrical side wall 41 having an open end 42 that is operatively engagable with the closed end 24 of the shell. Internally, the plunger defines a reservoir or low pressure chamber 44 defined at its lower end by a bottom wall 45. Wall 45 includes an orifice 46 controlled by a ball check valve 48 and connecting with a high pressure chamber 50 located within the lower end of the body 36. A compression plunger spring 52, located within the high pressure chamber 50, acts between the closed end 38 of the body and the plunger 40 to bias the body away from the closed upper end 24 of the shell 16.

Within the plunger, a control ring 58 is tightly fitted against the cylindrical side wall 41 of the plunger. The control ring is made of a material having a thermal expansion rate greater than that of the cylindrical side wall. For example, the control ring may be made of a suitable alloy of aluminum while the plunger is made of steel. The particular metals to be used and their relative thicknesses will be selected by the designer in order to accomplish the desired operating results as indicated below.

In operation, the hydraulic valve lifter 10 is mounted in a bore of a tappet gallery, not shown, of engine. Pressurized oil is provided from the engine tappet gallery to the groove 26 and through opening 28 to the annular first space 34 within the lifter. The oil is directed through a recess 54 in the closed end 24 of the shell 16 into the low pressure chamber 44 which forms a reservoir within the plunger 46. From there, oil is fed through the check valve controlled orifice 46 into the high pressure chamber 50. The oil is prevented from escaping by the check valve 48 and thus is trapped in the high pressure chamber, except for leakage through a close primary clearance 56 forming a leakdown path between the plunger 40 and the hollow body 36 within which the plunger is reciprocably received. The primary clearance 56 is specifically selected to provide a controlled amount of leakdown or flow of oil from the high pressure chamber during valve opening operation.

During normal operation, when the valve is opened, a small amount of oil passes through the primary clearance 56 out of the high pressure chamber 50. Then, when the cam again turns to its base circle, the valve is again returned to its seat and the plunger spring expands, extending the lash adjuster and taking up the lash in the valve train. Make up oil is then drawn from the low pressure chamber 44 through the check valve orifice 46 into the high pressure chamber 50 until the lash is fully taken up and the hydraulic valve lifter 10 is ready for the next valve opening event.

Under cold engine conditions, the lubricating oil supplied to the hydraulic valve lifter may have greatly increased viscosity so that, in a conventional hydraulic lash adjuster not fitted with a control ring 58, leakdown from the high pressure chamber is much less than during normal operating conditions. Under these conditions, rapid growth, particularly in an exhaust valve as it is rapidly heated during operation of the engine, may cause the length of the valve train to increase at a greater rate than leakdown of oil from the high pressure chamber 50 can accommodate. Thus, the valve may be held open a small amount when the cam returns to the base circle in a condition of the lash adjuster called thermal pump up, which is detrimental to engine operation and may cause stalling.

The thermal pump up condition is prevented in the above-described embodiment by operation of the control ring 58. The primary clearance 56 between the plunger 40 and body 36 is increased so that, when the oil is cold, the leakdown of oil when the engine valve is open is sufficient to prevent thermal pump up of the lash adjuster under all operating conditions. As the engine warms up, the higher expansion rate of the control ring forces the side wall 41 of the plunger to expand at a greater rate than the body 36. Thus, the primary clearance is reduced as the oil temperature increases. By proper selection of the materials and dimensions of the body, plunger and control ring, the change in clearance will counteract the change in viscosity of the oil so that the leakdown rate may be held more constant under all operating temperatures. Thus, thermal pump up of the lash adjuster and holding open of the associated valve will be avoided without requiring an excessive hot leakdown rate.

Figure 2:
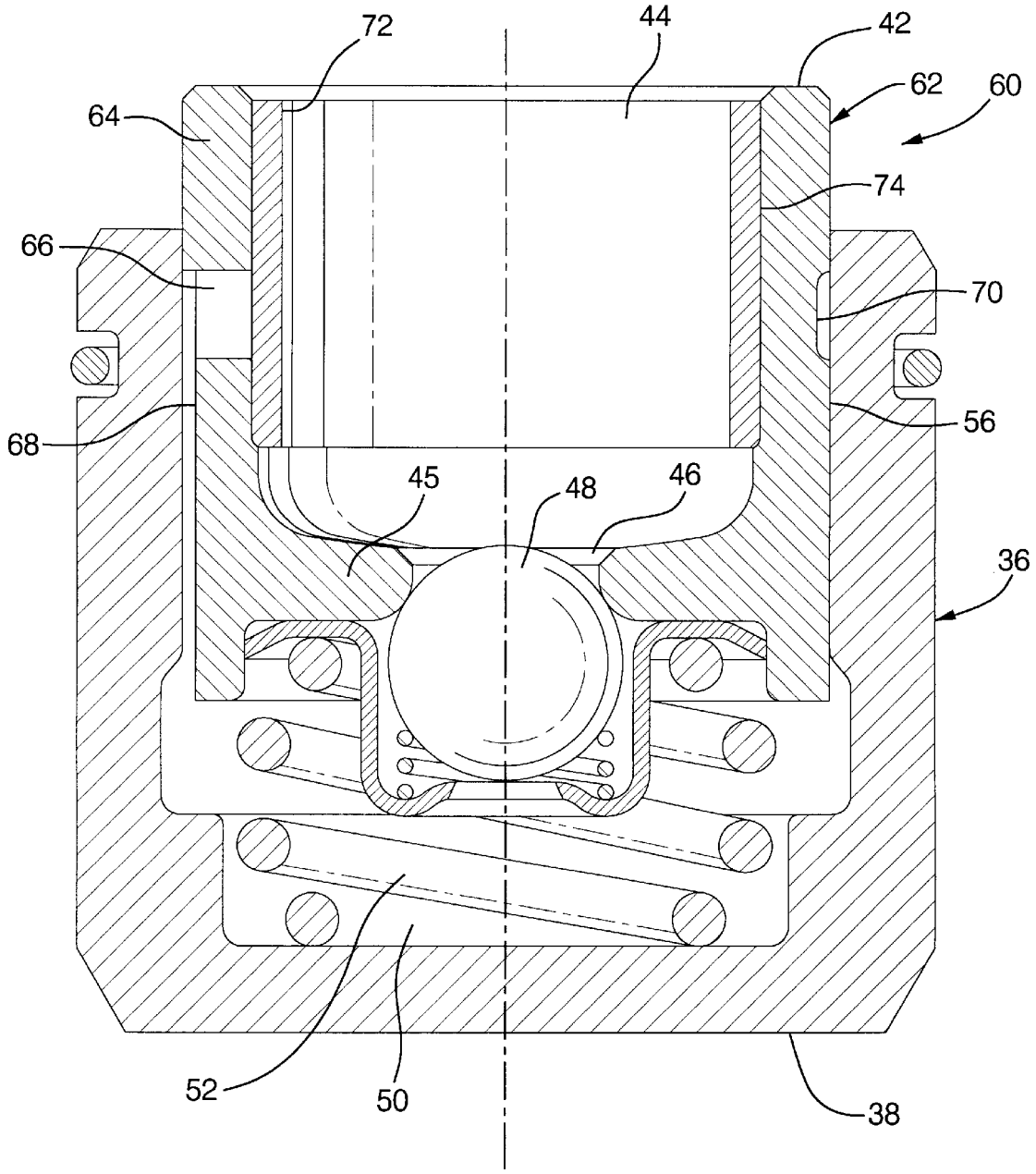
FIG. 2 is a cross-sectional view of a hydraulic element assembly for a direct acting hydraulic valve lifter, and exemplifying an alternative embodiment of hydraulic lash adjuster according to the invention.

Referring now to FIG. 2 of the drawings, numeral 60 generally indicates a hydraulic element assembly (HEA) incorporating an alternative embodiment of the invention. HEA 60 is capable of being substituted directly for the HEA 14 of the embodiment of FIG. 1 to provide a direct acting hydraulic valve lifter having the features of this alternative embodiment, in which like numerals indicate like parts.

HEA 60 includes a hollow body 36 with a closed end 38, as before. A modified plunger 62 is provided having a cylindrical side wall 64 with an open end 42 and defining internally a low pressure chamber 44. A bottom wall 45 includes orifice 46 controlled by a ball check valve 48, as in the previous embodiment. Between the plunger 62 and the closed end 38 of the body, a high pressure chamber 50 is defined in which a plunger spring 52 is disposed. Spring 52 urges the body 36 downwardly relative to the plunger and therefore away from the closed end 24 of an associated outer shell when the HEA is assembled in a direct acting hydraulic valve lifter.

Plunger 62 differs from the plunger of the embodiment of FIG. 1 by the inclusion of an opening 66 extending through the side wall to its exterior. The exterior of the plunger also includes a flat 68 extending from the opening 66 downward to the high pressure chamber 50 to provide a passage for oil flow between the high pressure chamber and the opening. Optionally, an annular groove 70 may be provided.

Within the cylindrical side wall 64 of the plunger, there is disposed a control ring 72 extending from below the opening 66 up to about the open end 42 of the plunger side wall. At ambient temperatures and in cold engine operating conditions, control ring 72 is loosely fitted within the plunger 62 so that a secondary clearance is provided between the control ring 72 and the plunger cylindrical side wall 64. This secondary clearance is in addition to the primary clearance which exists in this embodiment, as before, between the plunger cylindrical side wall 62 and the interior of the hollow body 36 in which the plunger reciprocates.

As in the previously described embodiment, the control ring 72 is made from a suitable material, such as aluminum, having a greater thermal expansion rate than the material, probably steel, of the plunger 62 and the associated body 36.

In one possible arrangement, the primary clearance 56 between the body 36 and plunger 60 is sized to provide a desired leakdown rate of oil from the high pressure chamber 50 to the exterior of the body when the engine is operating within a normal range of operating temperatures. However, under cold starting and operating conditions, the greater viscosity of the engine oil supplied to the lash adjuster-HEA could, as before, reduce the leakdown of oil from the high pressure chamber, while the associated engine valve is open, to a point where leakdown does not keep pace with the thermal growth of the valve train, as was previously described. Therefore, thermal pump up of the lifter and holding open of the exhaust valve could occur. This is prevented by the flow path along the flat 68 to the opening 66 to the secondary clearance 74, which is sized to allow the cold highly viscous oil to escape from the high pressure chamber at a rate sufficient to allow normal operation of the lifter under cold conditions and prevent thermal pump up of the lash adjuster HEA 60.

As the oil temperature increases, the control ring 72 expands, gradually reducing the secondary clearance 74 until, at normal operating temperatures, the secondary clearance may be completely closed by engagement of the control ring solidly with the side wall 64 of the plunger.

Optionally, the secondary clearance could be sized so that it is not completely closed under any operating condition and provides a continual flow modifying effect under various operating conditions. In another possibility, a control ring 72 could, at normal operating temperatures, apply a radial load to the side wall 64 of the plunger, as in the previous embodiment, so that the primary clearance 56 is also reduced for normal operation.

Figure 3:
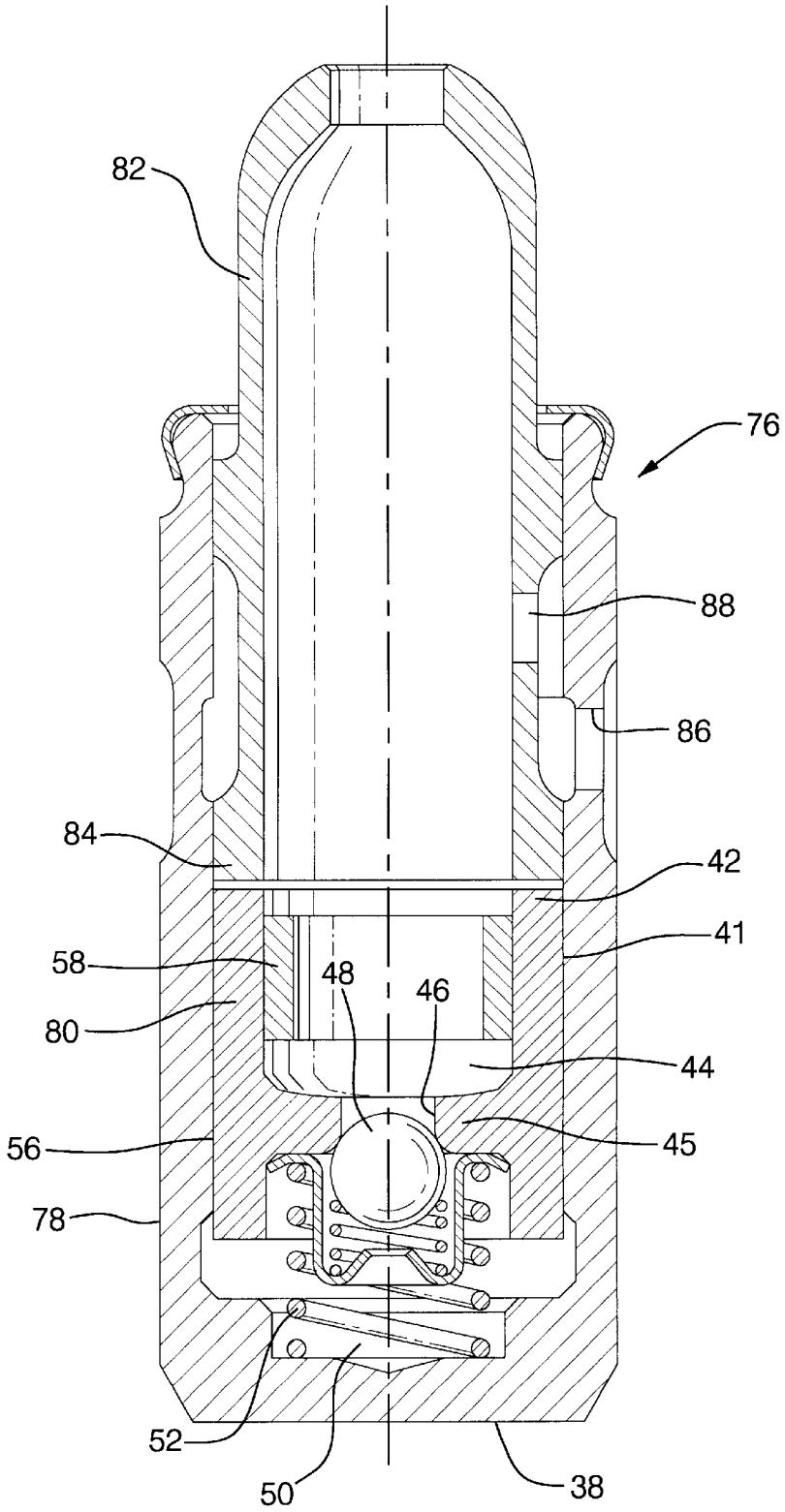
FIG. 3 is a cross-sectional view of another alternative embodiment of hydraulic lash adjuster according to the invention, usable as a pivot for a finger follower in an engine valve train.

Referring now to FIG. 3 of the drawings, numeral 76 generally indicates a stationary hydraulic lash adjuster (HLA) intended, for example, to act as a pivot for a finger follower in the valve train of an overhead cam engine. HLA 76 includes a conventional body 78 formed as a closed end cylinder receiving a plunger 80 directly contacting a piston 82 having a rounded end which serves as a pivot. The plunger is formed, as in the first described embodiment, to include a cylindrical side wall 41 and an open end 42 which engages an open end 84 of the piston 82. Together, the hollow interiors of the plunger and piston define an internal reservoir which is fed with engine oil through openings 86, 88 in the body and piston, respectively.

The plunger further includes a bottom wall 45 having an orifice 46 controlled by a check valve 48 and defining a high pressure chamber 50 with the closed end 38 of the body. Primary clearance 56 is provided between the body 78 and the cylindrical walls of the plunger 80 and piston 82 to provide leakdown from the high pressure chamber 50, as in the first described embodiment.

Also, in this embodiment, a control ring 58 is provided. The control ring is mounted and operates in the same manner as in the first described embodiment, in that it is tightly fitted within the cylindrical side wall of the plunger. The primary clearance is expanded to provide adequate leakdown under cold operating conditions and, as the oil temperature increases to normal operating temperature, the control ring 58 expands the cylindrical side wall of the plunger to close the primary clearance 56 to a smaller dimension which approximates that required to control leakdown to a level desired for normal operating temperatures. Thus, operation of the HLA of FIG. 3 is, in essence, identical to that of the HEA of FIG. 1.

In like manner, a plunger, like that of plunger 62 in FIG. 2, could be substituted in the HLA of FIG. 3 with the mode of operation then being the same as that of the HEA of FIG. 2. Similarly, the plungers of both FIGS. 1 and 2 could be used in lash adjusters designed for actuating push rods in a cam actuated push rod type engine valve gear with the same modes of operation as described above.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. A hydraulic lash adjuster capable of use in an engine valve train connecting a cam and a valve, said adjuster comprising:

a cup-shaped body with a peripheral outer wall defining an internal cylinder formed around an axis and having closed and open ends;

hydraulic means in the body including a plunger reciprocable along the cylinder axis and having a cylindrical side wall with an open end operatively engagable with a cooperating member of the valve train to take up lash in the associated valve train, the plunger defining a low pressure chamber for receiving hydraulic fluid supplied from the engine, the plunger being spaced from the closed end of the cylinder and defining therewith a high pressure chamber connected through a non-return check valve with the low pressure chamber for delivering fluid to the high pressure chamber, a plunger spring acting between the closed end of the cylinder and the plunger and urging the plunger toward engagement with said cooperating member of the valve train; and a control ring mounted within the plunger cylindrical side wall and having a thermal expansion rate greater than that of the cylindrical side wall, the control ring cooperating with the cylindrical side wall to control leakdown of hydraulic fluid through a leakdown path from the high pressure chamber during valve opening events of the valve gear;

wherein said leakdown path is formed by a secondary clearance between the control ring and the cylindrical wall of the plunger and means for communicating the secondary clearance with the high pressure chamber the control ring directly reducing the secondary clearance upon increasing temperature of the hydraulic fluid to thereby control the increase in fluid leakdown from the high pressure chamber due to reducing of fluid viscosity upon increasing fluid temperature.

2. A hydraulic lash adjuster as in claim 1 and forming a hydraulic element assembly combined into a direct acting hydraulic valve lifter including a cup-shaped outer shell having a cylindrical wall with closed and open ends and with an internal baffle defining a cylinder within the shell, said open end of the plunger engaging the closed end of the shell and said cup shaped body being reciprocably mounted in the baffle defined cylinder.

3. A hydraulic lash adjuster as in claim 1 wherein the peripheral wall of said body extends beyond the open end of the plunger and receives a hollow piston reciprocable in the internal cylinder, said hallow piston having a rounded outer end for acting as a pivot for a finger follower and an open inner end engaging the open end of the plunger.

4. A hydraulic lash adjuster as in claim 1 wherein the closed end of the body is formed for operative engagement with a cam and the peripheral wall of said body extends beyond the open end of the plunger and receives a hollow piston reciprocable in the internal cylinder, said hallow piston having an outer end configured for operative engagement with a valve actuating member of an associated valve mechanism.

5. A hydraulic lash adjuster as in claim 1 wherein said control ring is loosely fitted within the plunger with the secondary clearance maintained between the plunger and said cylindrical wall under low temperature operating conditions of the hydraulic fluid.

6. A hydraulic lash adjuster as in claim 5 wherein said means for communicating the secondary clearance with the high pressure chamber includes a connecting opening through the cylindrical wall of the plunger communicating the secondary clearance with a primary clearance between the plunger and the internal cylinder of the body, said primary clearance communicating with said high pressure chamber.

7. A hydraulic lash adjuster as in claim 6 wherein a connecting flat on the outside of the plunger cylindrical wall extends between the high pressure chamber and the connecting opening.

* * * * *